US010973309B2

(12) United States Patent
Thomas

(10) Patent No.: US 10,973,309 B2
(45) Date of Patent: Apr. 13, 2021

(54) JACKET AND COMBINATION BACKPACK

(71) Applicant: Creola Thomas, Chicago, IL (US)

(72) Inventor: Creola Thomas, Chicago, IL (US)

( * ) Notice: Subject to any disclaimer, the term of this patent is extended or adjusted under 35 U.S.C. 154(b) by 66 days.

(21) Appl. No.: 16/198,843

(22) Filed: Nov. 22, 2018

(65) Prior Publication Data

US 2019/0090620 A1 Mar. 28, 2019

Related U.S. Application Data

(63) Continuation-in-part of application No. 15/285,459, filed on Oct. 14, 2016, now abandoned.

(60) Provisional application No. 62/387,572, filed on Dec. 28, 2015.

(51) Int. Cl.

| | |
|---|---|
| ***A45F 4/12*** | (2006.01) |
| ***A41D 15/04*** | (2006.01) |
| ***A45F 3/04*** | (2006.01) |
| ***A45F 5/02*** | (2006.01) |
| ***A41D 1/02*** | (2006.01) |
| ***A41D 27/10*** | (2006.01) |
| ***A41D 3/00*** | (2006.01) |
| *A45F 3/00* | (2006.01) |

(52) U.S. Cl.

CPC ..... *A45F 5/02* (2013.01); *A41D 1/02* (2013.01); *A41D 3/00* (2013.01); *A41D 15/04* (2013.01); *A41D 27/10* (2013.01); *A45F 3/04* (2013.01); *A41D 2200/20* (2013.01); *A41D 2300/32* (2013.01); *A41D 2400/422* (2013.01); *A41D 2400/48* (2013.01); *A41D 2400/80* (2013.01); *A45F 2003/003* (2013.01)

(58) Field of Classification Search

CPC ..... A45F 4/12; A45F 3/04; A45F 3/14; A45F 4/00; A45F 4/02; A45F 5/02; A41D 15/04; A41D 15/00; A41D 15/005

USPC ..... 224/575, 576, 577, 153, 646, 581–583

See application file for complete search history.

(56) References Cited

U.S. PATENT DOCUMENTS

| | | | | |
|---|---|---|---|---|
| 4,272,852 | A * | 6/1981 | Bell | A41D 3/00 2/94 |
| 4,569,089 | A * | 2/1986 | Nesse | A41D 3/00 2/102 |
| 5,247,707 | A * | 9/1993 | Parker | A41D 13/0012 2/102 |
| 5,337,934 | A * | 8/1994 | Johnson | A41D 13/0012 224/148.5 |
| 5,673,836 | A * | 10/1997 | Bush | A41D 13/00 2/94 |
| 5,909,802 | A * | 6/1999 | Puco | A45F 3/04 2/102 |
| 6,393,613 | B1 * | 5/2002 | Sheu | A41D 15/04 2/94 |
| 6,619,519 | B1 * | 9/2003 | Nix | A45C 7/0086 224/153 |
| 8,845,376 | B2 * | 9/2014 | Oehlert | B63C 9/11 441/106 |

(Continued)

*Primary Examiner* — Adam J Waggenspack

(74) *Attorney, Agent, or Firm* — Hiram R. Peacock

(57) ABSTRACT

A versatile jacket and backpack that combines portability and wearability for maximum flexibility. The jacket can be worn in a variety of configurations, and even stored in the adaptable back pack when not in use. The jacket portion is reversible for stylistic variety and accommodates attachment of the backpack on both the front and back of the jacket.

10 Claims, 5 Drawing Sheets

(56) References Cited

U.S. PATENT DOCUMENTS

| | | | | |
|---|---|---|---|---|
| 9,022,269 | B1 * | 5/2015 | Woodcock | A45F 4/00 224/576 |
| 9,185,965 | B1 * | 11/2015 | Bhati | A45F 3/14 |
| 2005/0091724 | A1 * | 5/2005 | Snyder | A45F 4/12 2/86 |
| 2005/0273904 | A1 * | 12/2005 | Valdes | A41D 15/04 2/86 |
| 2007/0284403 | A1 * | 12/2007 | Minami | A47D 13/02 224/160 |
| 2010/0147910 | A1 * | 6/2010 | Schachtner | A47D 13/025 224/160 |

* cited by examiner

JACKET AND COMBINATION BACKPACK

CROSS REFERENCE TO RELATED APPLICATIONS

Continuation-in-part of application Ser. No. 15/285,459, filed on Oct. 4, 2016, which claims the benefit of provisional application No. 62/387,572, filed Dec. 28, 2015.

STATEMENT REGARDING FEDERALLY SPONSORED RESEARCH OR DEVELOPMENT

None.

TECHNICAL FIELD

This disclosure relates to clothing and accessories with multiple functions.

BACKGROUND

People have always desired to express themselves and their individuality through the clothes they wear, and with the combination of accessories and peripheral items that accompany their clothing. Striking the correct balance between fashion and functionality has not always been the goal of many articles of clothing. A jacket is often used just as much for layering of clothing as it is for its function of keeping the wearer warm. When the jacket is removed, the person would usually be required to carry the jacket so that it is not misplaced or stolen.

Similarly, backpacks are often carried as much for the look of having a bag to accessorize the wearers clothing, as they are for their functional purpose of carrying additional items without having to hold the items individually or in your hands. As styles and fashion change, sometimes backpacks are worn on the chest instead of on the back.

SUMMARY

In general, the present invention discloses a versatile hooded jacket capable of securing to itself the accompanying backpack, and capable of being stored securely within the rear panel of the backpack without reducing the internal storage space of the backpack when the jacket is not needed. The jacket has closeable openings on the side of the body and at the collar, so that both the arms and the hood can be folded in and put away. The zippers are concealed beneath flaps that are secured closed with hook and loop fasteners such as Velcro, or with magnetic strips. The body of the jacket has a front and back surface that allow the backpack to be attached to the jacket and worn on either the front surface of the jacket or on the back surface.

In one exemplary embodiment, the jacket and backpack are made of nylon on the outside with a thin cotton lining on the inside.

In another exemplary embodiment, the jacket is reversible to allow maximum variety of colors and style expressions by the wearer. When the jacket body is turned inside out, the backpack can still be attached to either the front or back surface of the jacket.

Certain advantages of this article of clothing include the ability to wear a jacket and not have to carry it in your hands after removal. The hood can be stored within the storage compartment contained in the collar of the jacket when not in use. When the jacket is not being worn, the arms of the jacket can be stored within the jacket body for compactness. When the jacket is not being worn, it can also be stored in the vertically zippered opening on the back surface of the backpack.

Another advantage of this article of clothing is the ability for the backpack to be worn on the front of the body in crowded places such as the subway or train station to prevent undetected theft of valuables.

This article of clothing can also be useful when engaging in many outdoor activities including hiking, biking, and rock climbing. The loop fastener of the jacket and the hook fastener of the backpack work together to attach the backpack to the jacket and reduce the movement of the backpack created by the motion of the wearer when climbing, biking or hiking.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
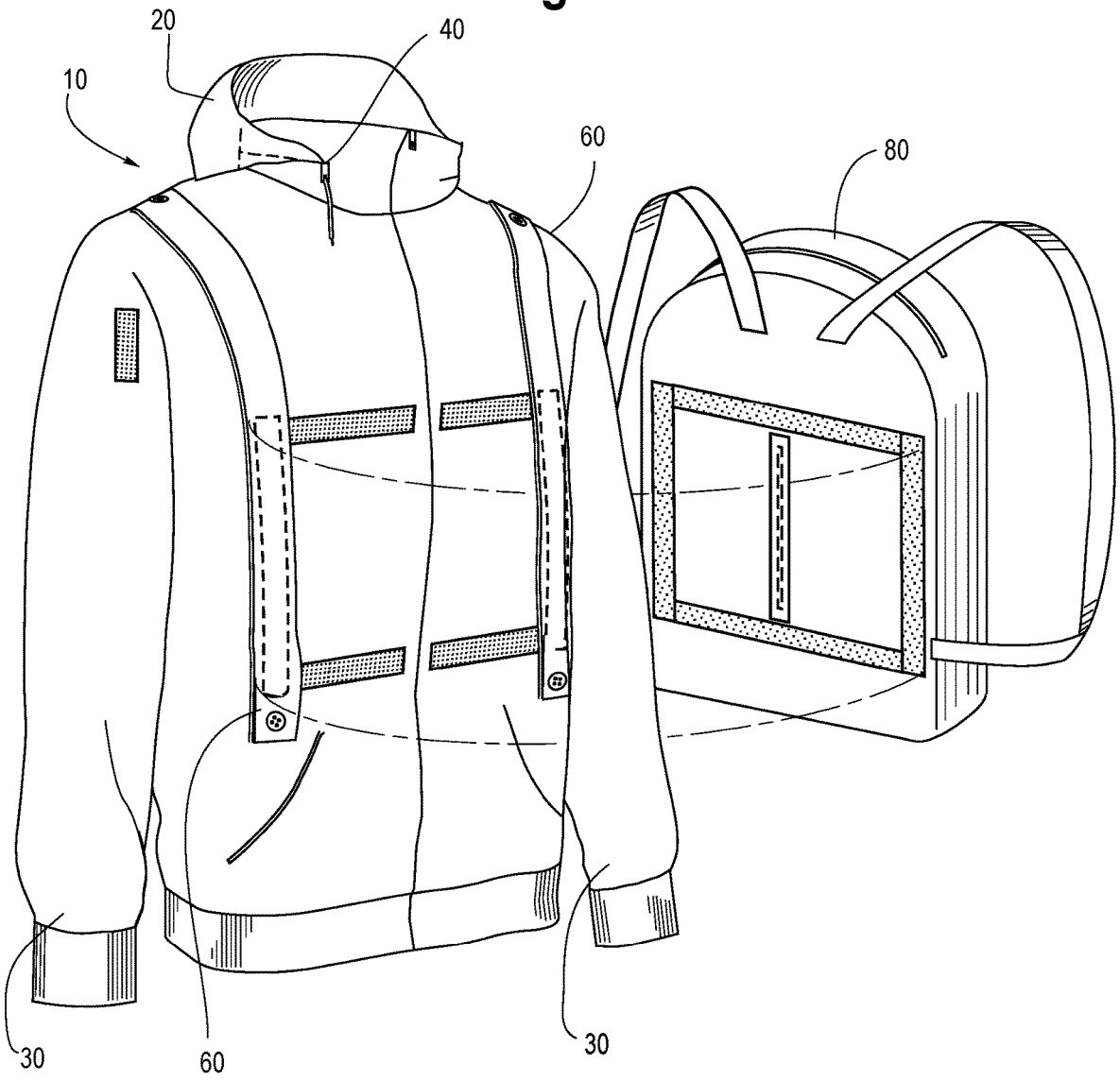
FIG. 1 is a perspective view of the front of the jacket and backpack.

FIG. 1 shows the front of the jacket 10, as well as the hook and loop attachment means for the jacket 10 and backpack 80, such that both the attachment means and the backpack straps can be used to support and secure the backpack on the user. The loop portion of the attachment means on the jacket 10 is combined with the hook portion of the attachment means on the backpack 80 when the attachment straps 60 are moved. The attachment straps 60 are reversible from front to back to cover the attachment means that is not currently being used. The hood 20 can be stored within the zippered compartment of the collar that is accessible via the hood zipper 40. The vertical recessed opening in the center of the back surface of the backpack 80 can be used to store the jacket when it is not being used so that the user does not have to carry the jacket.

Figure 2:
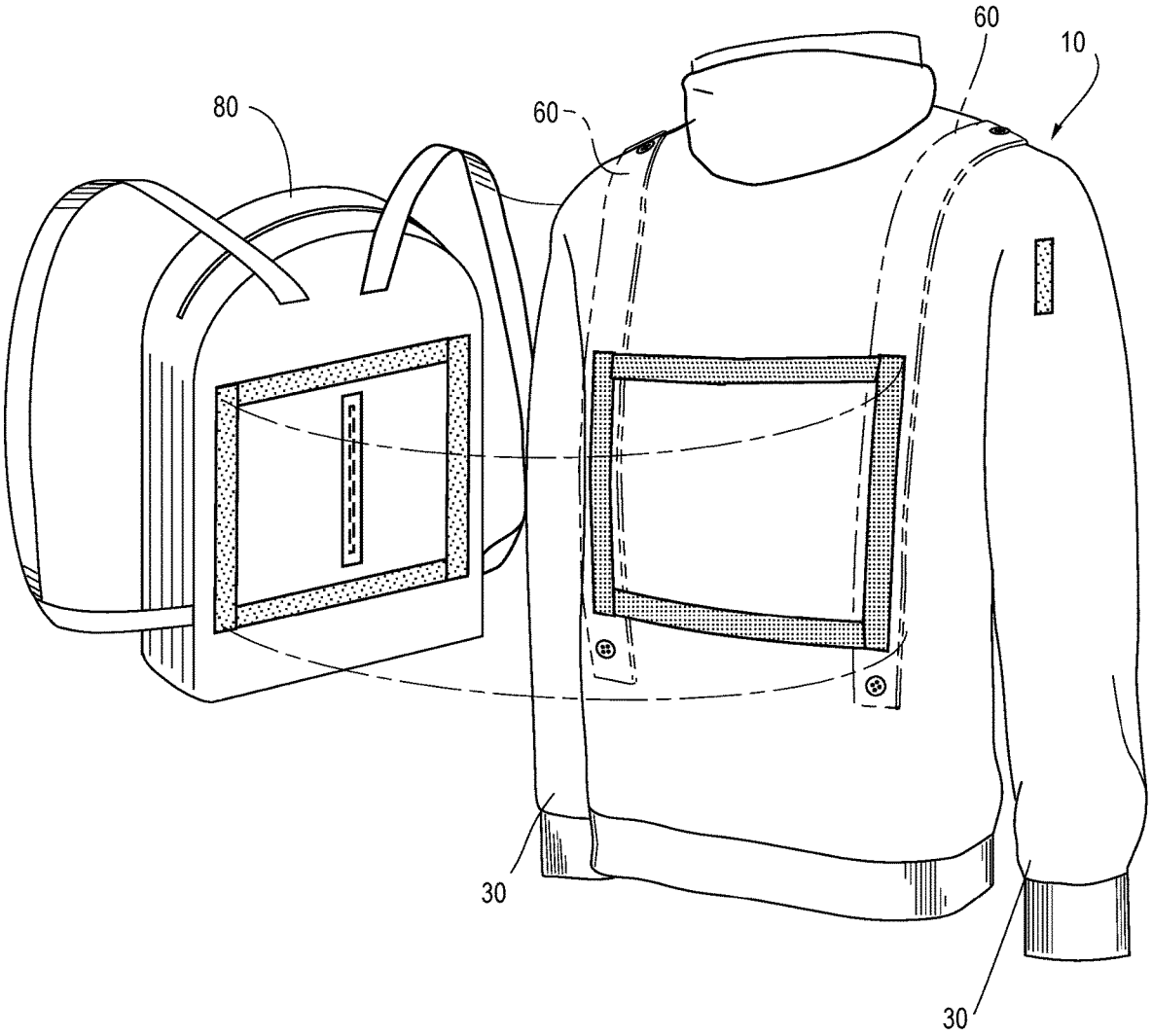
FIG. 2 is a perspective view of the back of the jacket and backpack.

FIG. 2 shows the view of the back of the jacket 10 as the backpack 80 is to be attached via the rear attachment means by removing the button down straps 60 that cover the vertical portion of the attachment means. The wearer's arms and the jacket sleeves 30 can be placed through the shoulder straps of the backpack 80 so that the weight of the backpack is supported by the shoulder straps, and additionally supported by the attachment means that attaches the backpack 80 to the back surface of the jacket 10.

Figure 3:
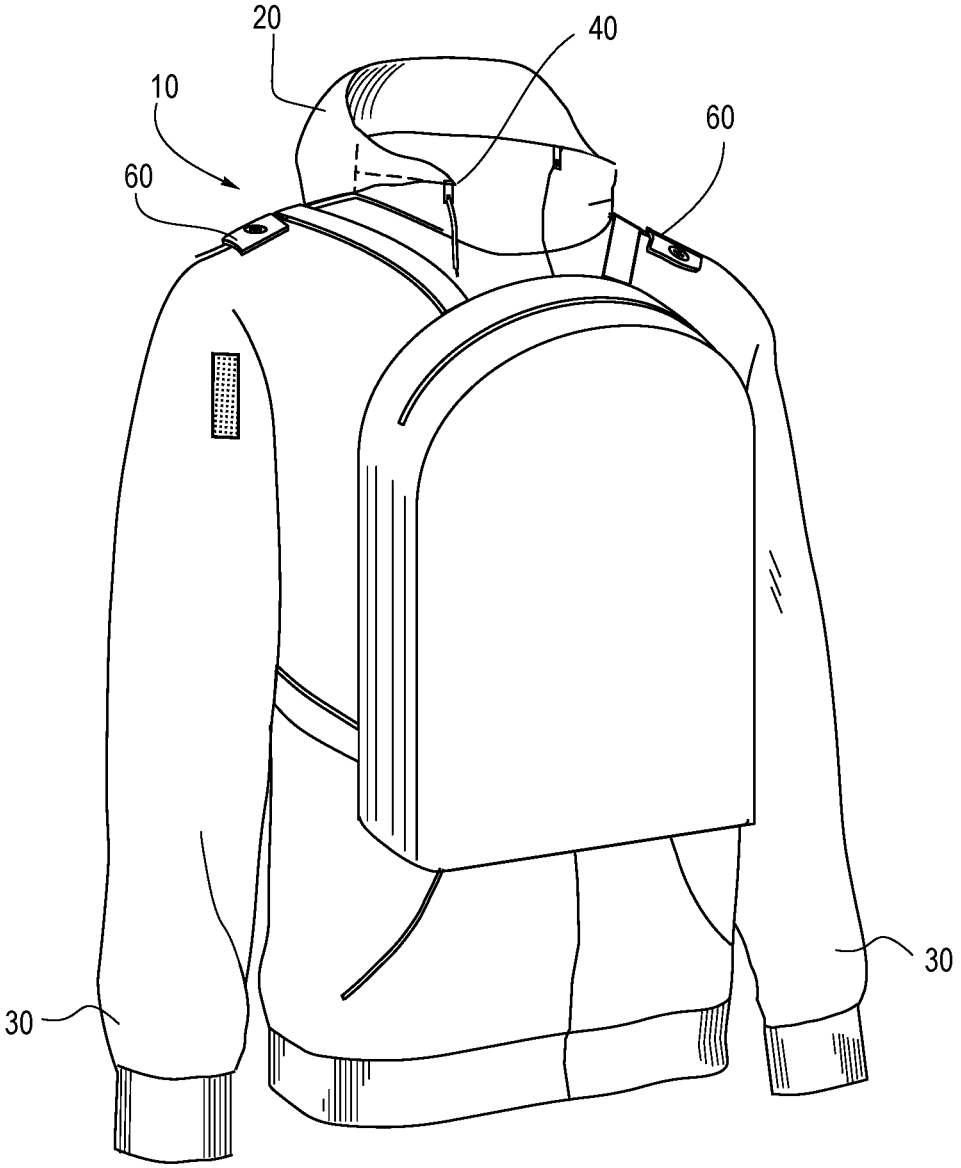
FIG. 3 is a perspective view of the front of the jacket with the backpack attached to the front.

FIG. 3 shows the jacket 10 with the backpack attached to the front surface of the jacket via the front surface attachment means on the jacket (not shown beneath the backpack) and the rear surface attachment means of the backpack (not shown beneath the backpack) as well as the shoulder straps of the backpack providing support for the backpack. The loop portion of the arm fastener is seen on the right arm sleeve 30.

Figure 4:
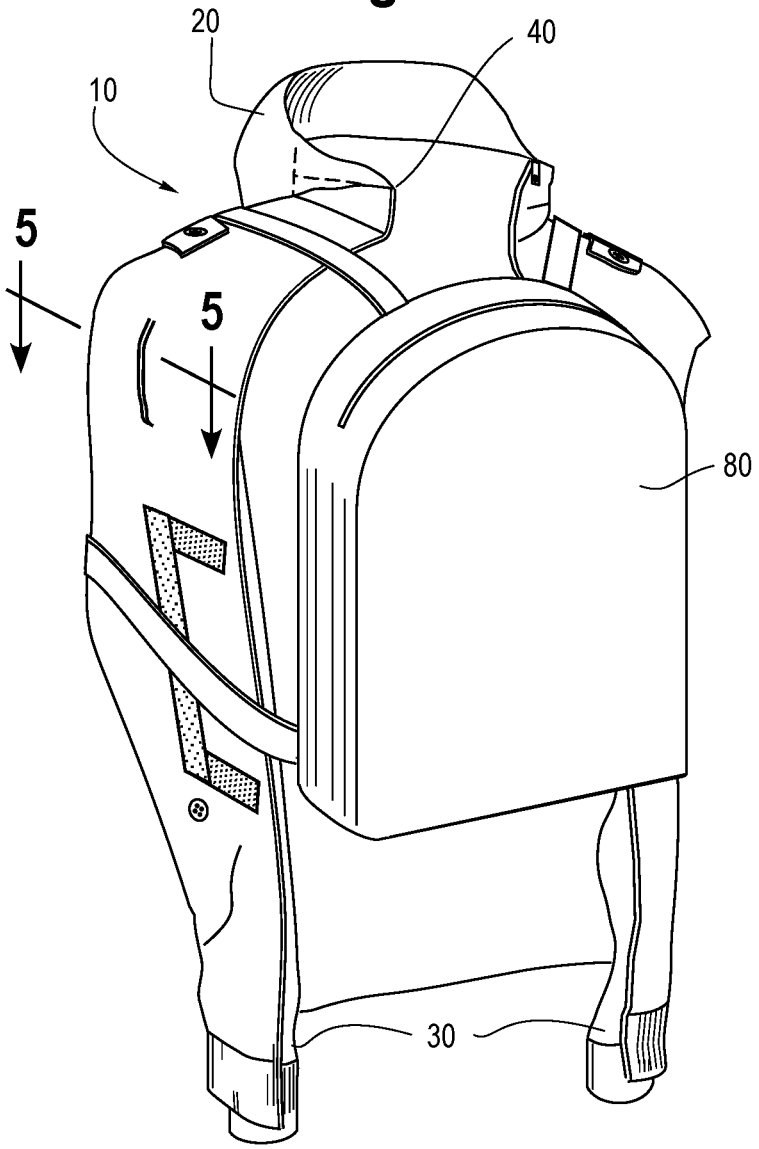
FIG. 4 is a perspective view of the front of the jacket with the arms secured within the jacket for carrying the jacket flat against the backpack instead of wearing the jacket, with the backpack straps worn over the shoulders.

FIG. 4 shows the jacket with the sleeves inverted to the inside of the jacket for storage when the jacket is not being worn, such that the jacket 10 can be carried pressed flat against the rear surface of the backpack 80, with the backpack straps placed over the shoulders. The attachment means of the jacket and the attachment means on the rear surface of the backpack can be connected to hold the jacket in place between the wearer and the backpack.

Figure 5:
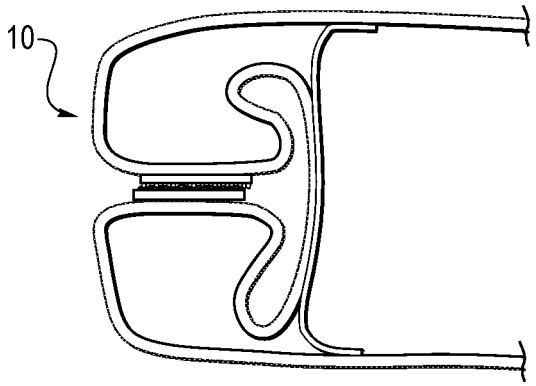
FIG. 5 shows a cross section view at 5-5 with hook and loop fasteners.

FIG. 5 shows the cross section of the jacket at 5-5 where the arm portion of the jacket is secured in a closed position with hook and loop fastener.

Figure 6:
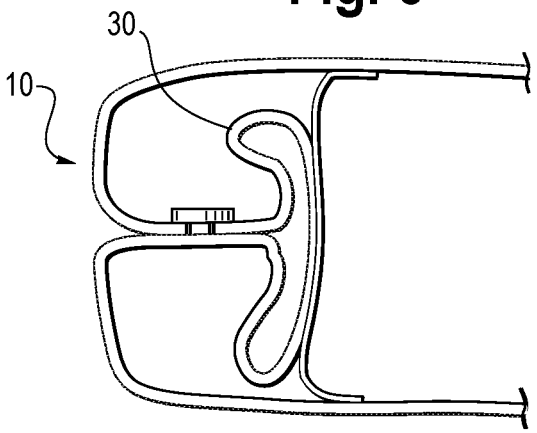
FIG. 6 shows a cross section view at 5-5 with a button fastener.

FIG. 6 show the cross section of FIG. 4 at 5-5 with the arm portion of the jacket secured in a closed position with a button fastener.

Figure 7:
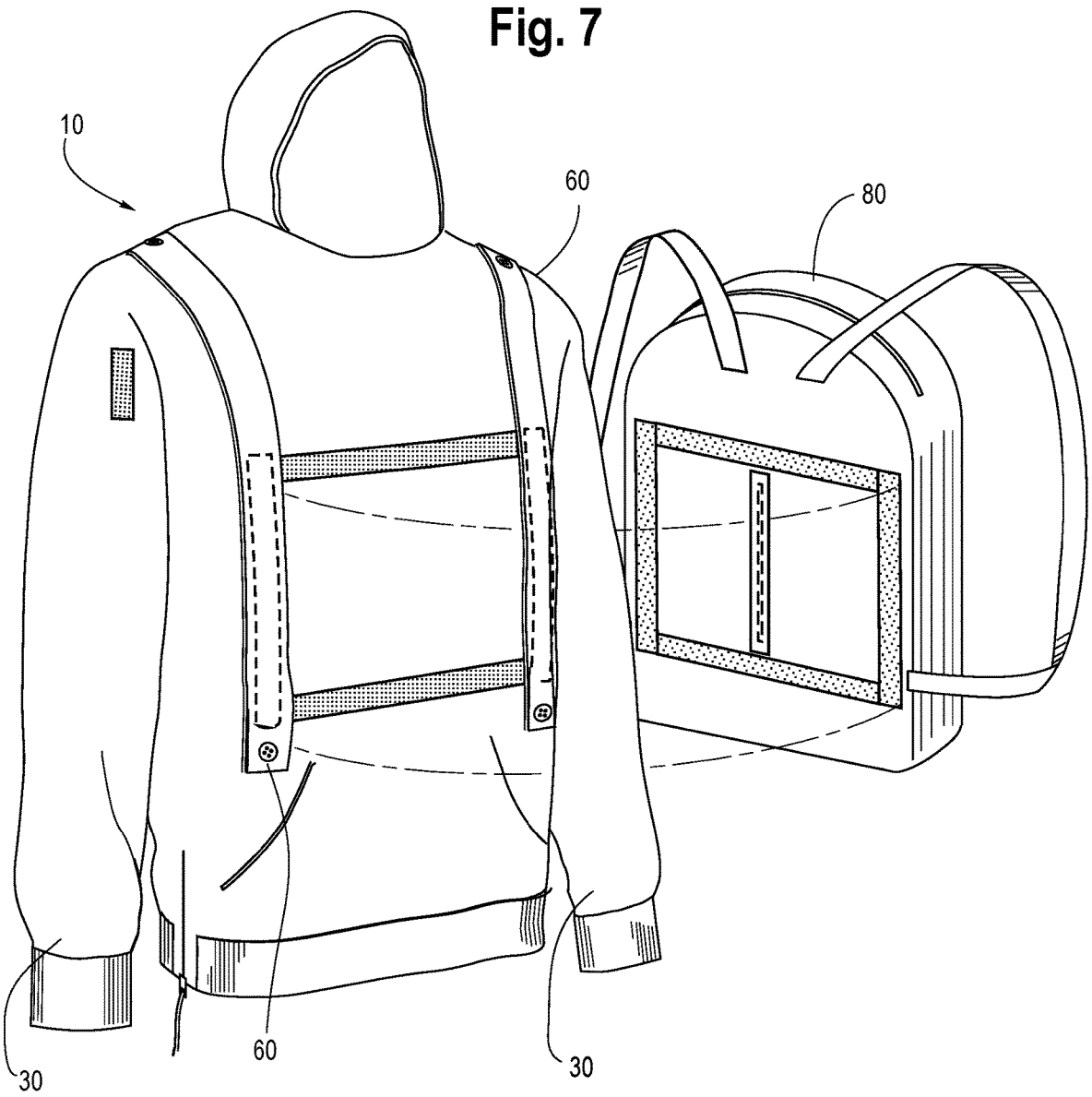
FIG. 7 shows front perspective view of the hooded pullover jacket and backpack.

FIG. 7 shows an alternate pullover embodiment of the jacket 10 with side zippers to enlarge the opening at the bottom of the jacket to make it easier to pull the jacket over the head and shoulders of the wearer. The attachment means on the back surface of the backpack can be attached to the attachment means on the front surface of the jacket. The button down straps 60 can be reversed to the back surface of the jacket 10 when the backpack 80 is worn on the front surface of the jacket 10.

A number of illustrative embodiments have been described. Nevertheless, it will be understood that various modifications may be made without departing from the spirit and scope of the various embodiments presented herein. For example, the backpack can be worn not only in the front or on the back of the jacket, but also on the reversible inside of the jacket. The jacket body can be inverted to display a different style or color, yet still be worn as a jacket and or a backpack. Accordingly, other embodiments are within the scope of the following claims.

What is claimed is:

1. A combination jacket and backpack comprising: a jacket, having a front and a back surface, a collar region, and two arm members; a backpack having a front and a back surface, a top and a bottom surface, one or more shoulder straps, a primary and a secondary storage compartment, a vertical opening with a reusable closure means on the back surface for accessing the secondary storage compartment for insertion and storage of the jacket when it is not being worn, and a horizontal opening with a reusable closure means across the top surface for accessing the primary storage compartment; a first attachment means on the front surface of the jacket, a second attachment means on the back surface of the jacket, a third attachment means on the back surface of the backpack for mating optionally with either the first or second attachment means for releasable attachment of the back surface of the backpack to the front or back surface of the jacket, a reversible mating strap having a top side and an underside with the underside having a fourth attachment means for securing the mating strap over the first or second attachment means for interchangeable use on either the front or rear of the garment in covering the attachment means when the attachment means are not in use, one end of the reversible mating strap being connected to the jacket by a fifth fastener.

2. The combination jacket and backpack of claim 1 wherein the attachment means comprise sets of hook and loop fasteners.

3. The combination jacket and backpack of claim 2, further including an attachment means on each of the arm members whereby the arm members can be stored inside the jacket with the arm opening being secured by the attachment means.

4. The combination jacket and backpack of claim 1, wherein the collar region further comprises a zippered compartment for storage of a hood.

5. The combination jacket and backpack of claim 1, wherein the jacket and backpack are comprised of a nylon material.

6. The combination jacket and backpack of claim 1, wherein the jacket is comprised of a nylon material and has an internal cotton lining.

7. The combination jacket and backpack of claim 1, wherein the back surface of the backpack further contains a padding material for enhanced comfort of the user.

8. A method for using a combination jacket and backpack, the method comprising:

providing a jacket including: an enclosable hood, a zippered hood storage compartment, a backpack attachment means on a front surface and a back surface of the jacket, and a strap including an attachment mechanism for reversibly securing said mating means in place optionally over either the front or rear attachment means for interchangeable use on either the front or the rear of the jacket, the strap means having a fastener on the first end to secure the strap to the jacket;

providing a backpack including: a pair of shoulder straps, a jacket attachment means, a vertical rear opening, and a horizontal top surface opening;

placing the mating means over the front or rear attachment means and securing it with the attachment mechanism on the strap;

attaching the backpack to the back surface of the jacket or to the front surface of the jacket by attaching the jacket attachment means to the backpack attachment means so that the backpack does not bounce or shift from the user's movement; and wearing the backpack while storing the jacket within the vertical rear opening of the backpack whereby the user's hands remain free.

9. The method of claim 8 further including: providing the user with the option to wear the backpack while storing the jacket within the vertical rear opening of the backpack whereby the user's hands remain free.

10. The method of claim 8, further including providing the user the option to wear the backpack without wearing the jacket by securing the front surface of the jacket to the back surface of the backpack and placing the backpack on the user with the jacket placed between the user and the backpack and held in place via the attachment means.

* * * * *